US010680364B2

(12) United States Patent
Champion et al.

(10) Patent No.: US 10,680,364 B2
(45) Date of Patent: Jun. 9, 2020

(54) DIRECT MATE PLUGGABLE MODULE FOR A COMMUNICATION SYSTEM

(71) Applicant: TE CONNECTIVITY CORPORATION, Berwyn, PA (US)

(72) Inventors: Bruce Allen Champion, Camp Hill, PA (US); Christopher William Blackburn, Bothell, WA (US); Eric David Briant, Dillsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/274,899

(22) Filed: Feb. 13, 2019

(65) Prior Publication Data

US 2019/0288422 A1 Sep. 19, 2019

Related U.S. Application Data

(60) Provisional application No. 62/644,121, filed on Mar. 16, 2018.

(51) Int. Cl.
*H01R 12/72* (2011.01)
*H01R 13/6582* (2011.01)
*H01R 13/6587* (2011.01)

(52) U.S. Cl.
CPC ..... *H01R 12/721* (2013.01); *H01R 12/724* (2013.01); *H01R 13/6582* (2013.01); *H01R 13/6587* (2013.01)

(58) Field of Classification Search
CPC ..... H01R 12/721
See application file for complete search history.

(56) References Cited

U.S. PATENT DOCUMENTS

| | | | | |
|---|---|---|---|---|
| 9,011,177 | B2 | 4/2015 | Lloyd et al. | |
| 9,520,659 | B2 | 12/2016 | Loibl et al. | |
| 9,735,484 | B2 | 8/2017 | Brubaker et al. | |
| 2014/0187087 | A1* | 7/2014 | Mason | H01R 13/6592 439/607.36 |

FOREIGN PATENT DOCUMENTS

| | | |
|---|---|---|
| CN | 103427181 B | 11/2015 |

* cited by examiner

*Primary Examiner* — Ross N Gushi

(57) ABSTRACT

A communication system includes a host circuit board, a receptacle assembly mounted to the host circuit board having a cage member defining a module cavity, and a pluggable module having a pluggable body loaded into the module cavity. The pluggable body has a mating interface along a bottom of the pluggable body facing the host circuit board. The pluggable module has a cable assembly having a cable and a cable connector at an end of the cable including signal contacts held by a contact holder that are terminated to signal conductors of the cable. The signal contacts have deflectable spring beams and mating interfaces along the deflectable spring beams exposed at the mating interface of the pluggable body to engage and directly mate with corresponding signal pads of the host circuit board.

20 Claims, 7 Drawing Sheets

DIRECT MATE PLUGGABLE MODULE FOR A COMMUNICATION SYSTEM

CROSS REFERENCE TO RELATED APPLICATIONS

This application claims benefit to U.S. Provisional Application No. 62/644,121, filed Mar. 16, 2018, titled "DIRECT MATE PLUGGABLE MODULE FOR A COMMUNICATION SYSTEM", the subject matter of which is herein incorporated by reference in its entirety.

BACKGROUND OF THE INVENTION

The subject matter herein relates generally to communication systems having pluggable modules.

At least some known communication systems include receptacle assemblies, such as input/output (I/O) connector assemblies, that are configured to receive a pluggable module and establish a communicative connection between the pluggable module and a host circuit board. As one example, a known receptacle assembly includes a cage member member that is mounted to a circuit board and configured to receive a pluggable transceiver in an elongated cavity of the cage member member. The receptacle assembly includes an electrical communication connector includes contacts terminated to the host circuit board, such as by soldering or a press-fit connection. The contacts of the electrical communication connector having mating ends in a card slot for mating with the pluggable module. The pluggable module has a circuit card therein that is received in the card slot to make the electrical connection with the electrical communication connector. The cables of the pluggable module are terminated to the circuit card, such as by soldering the conductors of the cables to the circuit card.

Conventional communication systems are not without disadvantages. For instance, the communication systems have multiple interfaces between the conductors of the cables and the host circuit board. For instance, there are interfaces defined between the conductors and the circuit card of the pluggable module, between the circuit card and the contacts of the electrical communication connector of the receptacle assembly, and between the contacts of the electrical communication connector and the host circuit board. The electrical communication connector of the receptacle assembly mounted to the host circuit board adds cost to the system and causes issues and electrical performance in regards to reflections, noise and attenuation, particularly at high speeds. Similarly, the circuit card in the pluggable module adds cost to the system and causes issues and electrical performance in regards to reflections, noise and attenuation, particularly at high speeds.

Accordingly, there is a need for a communication system having a robust and efficient signal path between the pluggable module and the host circuit board.

BRIEF DESCRIPTION OF THE INVENTION

In one embodiment, a communication system is provided including a host circuit board having a mounting area and signal pads within the mounting area and a receptacle assembly mounted to the host circuit board at the mounting area. The receptacle assembly has a cage member including a plurality of walls defining a module cavity. The walls provide electrical shielding around the module cavity. The cage member has a port at a front of the cage member open to the module cavity. The communication system includes a pluggable module having a pluggable body including a mating end and a cable end. The mating end of the pluggable body is loaded into the module cavity of the receptacle assembly through the port. The pluggable body has a mating interface along a bottom of the pluggable body facing the host circuit board. The pluggable module has a cable assembly held by the pluggable body having a cable exiting the pluggable body at the cable end. The cable assembly has a cable connector at an end of the cable including signal contacts held by a contact holder. The signal contacts are terminated to signal conductors of the cable. The signal contacts have deflectable spring beams and mating interfaces along the deflectable spring beams exposed at the mating interface of the pluggable body to engage and directly mate with corresponding signal pads of the host circuit board.

In another embodiment, a pluggable module is provided including a pluggable body having a mating end and a cable end. The pluggable body has a mating interface along a bottom of the pluggable body. The mating end of the pluggable body is configured to be loaded into a receptacle assembly such that the mating interface faces a host circuit board. The pluggable module includes a cable assembly held by the pluggable body. The cable assembly has a cable exiting the pluggable body at the cable end. The cable assembly has a cable connector at an end of the cable. The cable connector includes signal contacts held by a contact holder. The signal contacts are terminated to signal conductors of the cable. The signal contacts have deflectable spring beams and mating interfaces along the deflectable spring beams exposed at the mating interface of the pluggable body to engage and directly mate with signal pads on the host circuit board.

In a further embodiment, a pluggable module is provided including a pluggable body having a mating end and a cable end. The pluggable body has a mating interface along a bottom of the pluggable body extending longitudinally between the mating end and the cable end. The mating end is configured to be loaded into a receptacle assembly in a mating direction parallel to a host circuit board and the pluggable body is configured to be received in the receptacle assembly such that the mating interface faces the host circuit board. The pluggable module includes a first cable assembly held by the pluggable body having a first cable exiting the pluggable body at the cable end and having a first cable connector at an end of the first cable. The first cable connector includes first signal contacts held by a first contact holder terminated to first signal conductors of the first cable. The first signal contacts have deflectable spring beams and mating interfaces along the deflectable spring beams exposed at the mating interface of the pluggable body to engage and directly mate with first signal pads on the host circuit board. The pluggable module includes a second cable assembly held by the pluggable body having a second cable exiting the pluggable body at the cable end and having a second cable connector at an end of the second cable. The second cable connector includes second signal contacts held by a second contact holder terminated to second signal conductors of the second cable. The second signal contacts have deflectable spring beams and mating interfaces along the deflectable spring beams exposed at the mating interface of the pluggable body to engage and directly mate with second signal pads on the host circuit board. The second cable assembly is longitudinally offset from the first cable assembly such that the second cable connector is positioned closer to the cable end of the pluggable body than the first cable connector.

DETAILED DESCRIPTION OF THE INVENTION

Figure 1:
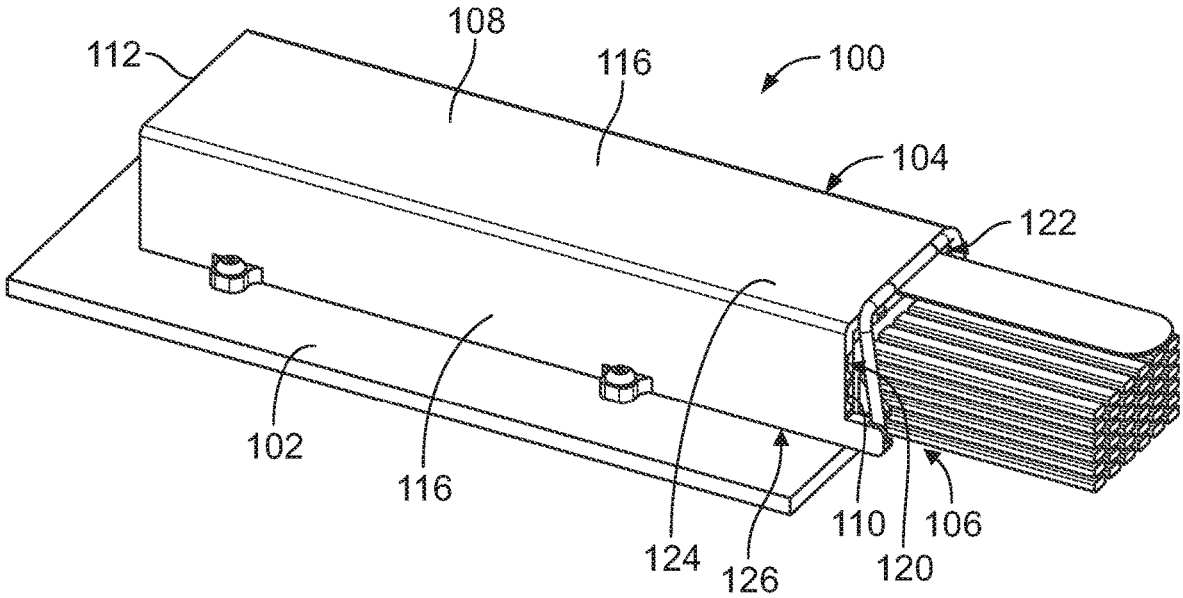
FIG. 1 is a front perspective view of a communication system in accordance with an embodiment.

FIG. 1 is a front perspective view of a communication system 100 in accordance with an embodiment. The communication system 100 includes a host circuit board 102, a receptacle assembly 104 mounted to the host circuit board 102, and a pluggable module 106 that is configured to be received in the receptacle assembly 104. The host circuit board 102 may be a daughter card or a mother board and include conductive traces (not shown) extending therethrough. In an exemplary embodiment, the pluggable module 106 is configured to be direct mated to the host circuit board 102 within the receptacle assembly 104, such as directly to the conductive traces of the host circuit board 102.

The communication system 100 may be part of or used with telecommunication systems or devices. For example, the communication system 100 may be part of or include a switch, router, server, hub, network interface card, or storage system. In the illustrated embodiment, the pluggable module 106 is an input/output (I/O) module configured to be inserted into and removed from the receptacle assembly 104. The pluggable module 106 is configured to transmit data signals in the form of electrical signals.

In the illustrated embodiment, the receptacle assembly 104 is illustrated as a single port receptacle assembly configured to receive a single pluggable module 106; however, the receptacle assembly 104 may be a multi-port receptacle assembly in other embodiments configured to receive pluggable modules 106 in multiple ports. For example, the multiple ports of the receptacle assembly 104 may be ganged side-by-side along the top surface of the host circuit board 102.

The receptacle assembly 104 includes a cage member 108 that is mounted to the host circuit board 102. The cage member 108 may be arranged at a bezel or panel (not shown) of a chassis of the system or device, such as through an opening in the panel. As such, the cage member 108 is interior of the device and corresponding panel and the pluggable module(s) 106 is loaded into the cage member 108 from outside or exterior of the device and corresponding panel. Optionally, the panel may include a plurality of openings each configured to receive a corresponding pluggable module 106.

The cage member 108 includes a front end 110 and an opposite rear end 112. The front end 110 may be provided at, and extend through an opening in, the panel. Relative or spatial terms such as "front," "rear," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104. The pluggable module 106 is accessible to the user and viewable to the user when the pluggable module 106 is inserted into the receptacle assembly 104.

The cage member 108 is configured to contain or block interference, such as electromagnetic interference (EMI), and guide the pluggable module(s) 106 during a mating operation. To this end, the cage member 108 includes multiple pieces assembled together to enclose the pluggable module 106. For example, the pieces may be snap-fit together and/or welded together. When the cage member 108 is mounted to the host circuit board 102, the cage member 108 is electrically coupled to the host circuit board 102 and, in particular, to ground planes (not shown) within the host circuit board 102 to electrically ground the cage member 108. As such, the receptacle assembly 104 may reduce EMI that may negatively affect electrical performance of the communication system 100. The pluggable module 106 may be electrically commoned with or grounded to the cage member 108, such as for EMI containment and/or shielding. For example, the pluggable module 106 may directly engage a portion of the cage member 108, such as an EMI gasket at the opening to the cage member 108.

In an exemplary embodiment, the cage member 108 includes a plurality of housing panels or walls 116, which may be formed from one or more pieces. The various walls 116 provide shielding for vulnerable areas of other components, such as by covering or shielding openings in walls of the other components. The cage member 108 extends between the front end 110 and the rear end 112. The walls 116 are formed from conductive material, such as sheet metal and/or a polymer having conductive particles. In the illustrated embodiment, the pieces are stamped and formed from sheet metal. In some embodiments, the cage member 108 is configured to facilitate airflow through the cage member 108 to transfer heat (or thermal energy) away from the receptacle assembly 104 and the pluggable module(s) 106. The air may flow from inside the cage member 108 (for example, behind the panel) to the external environment (for example, forward of the panel) or from outside the cage member 108 into the interior of the cage member 108. Fans or other air moving devices may be used to increase airflow through the cage member 108 and over the pluggable module(s) 106.

The cage member 108 defines a module cavity 120 extending between the front and rear ends 110, 112. The cage member 108 has a port 122 at the front end 110 that is open to the module cavity 120. The module cavity 120 receives the pluggable module 106 through the port 122. The module cavity 120 extends lengthwise in a direction that is parallel to the plugging axis of the pluggable module 106. For a multi-port receptacle assembly 104, multiple module cavities 120 or ports are defined for receiving multiple pluggable modules 106. In such embodiments, the module cavities 120 may be ganged horizontally. Separator panels may be provided between the module cavities 120 to provide shielding between the module cavities 120.

In an exemplary embodiment, the cage member 108 has a top 124 and a bottom 126. The cage member 108 includes one of the walls 116 at the top 124. The bottom 126 is mounted to the host circuit board 102. In an exemplary embodiment, the bottom 126 is open to allow the pluggable module 106 to directly mate with the host circuit board 102 at the bottom 126.

In an exemplary embodiment, the receptacle assembly 104 may include an EMI gasket (not shown) at the front end 110 of the cage member 108. The EMI gasket may interface with the panel, such as within the opening in the panel that receives the receptacle assembly 104. The EMI gasket may extend into the module cavity 120 to engage the pluggable module 106.

Figure 2:
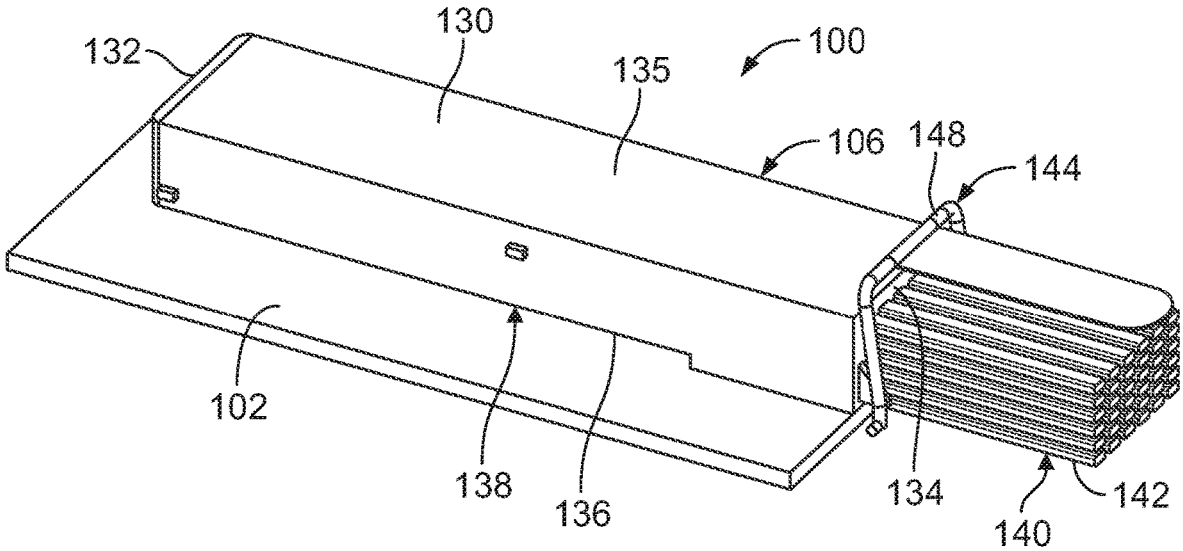
FIG. 2 is a perspective view of a portion of the communication system showing a pluggable module in accordance with an exemplary embodiment.

FIG. 2 is a perspective view of a portion of the communication system 100 showing the pluggable module 106 in accordance with an exemplary embodiment. The cage member 108 (FIG. 1) has been removed to illustrate the pluggable module 106 relative to the host circuit board 102. The pluggable module 106 is configured to directly mate with the host circuit board 102 without the need for a separate communication connector mounted to the host circuit board 102 as is common with conventional communication systems.

The pluggable module 106 has a pluggable body 130, which may be defined by one or more shells. The pluggable module 106 has a cable assembly 140 held by the pluggable body 130. Optionally, the pluggable body 130 may provide heat transfer for the cable assembly 140. The pluggable body 130 includes a rear end or mating end 132 and an opposite front end or cable end 134. The mating end 132 is configured to be inserted into the module cavity 120 (shown in FIG. 1). The cable assembly 140 has one or more cables 142 extending from the cable end 134 that may be routed to another component within the system. The cable end 134 may be exposed forward of the panel from the exterior of the receptacle assembly 104.

The pluggable body 130 has a top 135 and a bottom 136. The bottom 136 faces the host circuit board 102. The bottom 136 defines a mating interface 138 configured to be mounted to the host circuit board 102. The top 135 and the bottom 136 extend longitudinally between the mating end 132 and the cable end 134. In an exemplary embodiment, the pluggable module 106 is loaded into the cage member 108 in a loading direction, which may be generally parallel to the host circuit board 102, and the pluggable module 106 is mated with the host circuit board 102 in a mating direction, which may be generally perpendicular to the loading direction. For example, the pluggable body 130 may be pressed downward toward the host circuit board 102 to directly mate the pluggable module 106 with the host circuit board 102. Optionally, the cage member 108 may include features that engage the pluggable body 130 and force the pluggable body 130 in the downward mating direction toward the host circuit board 102.

In an exemplary embodiment, the pluggable module 106 includes a latch 144 for latchably securing the pluggable module 106 to the cage member 108 and/or the host circuit board 102. The latch 144 may include a latching feature (not shown) configured to engage the cage member 108 and/or the host circuit board 102. The latching feature may be released to release the pluggable module 106 to allow the pluggable module 106 to be removed from the cage member 108. In an exemplary embodiment, the latch 144 includes an actuator 148, such as a pull tab or lanyard, used to release the latch 144. The actuator 148 extends forward of the pluggable body 130.

Figure 3:
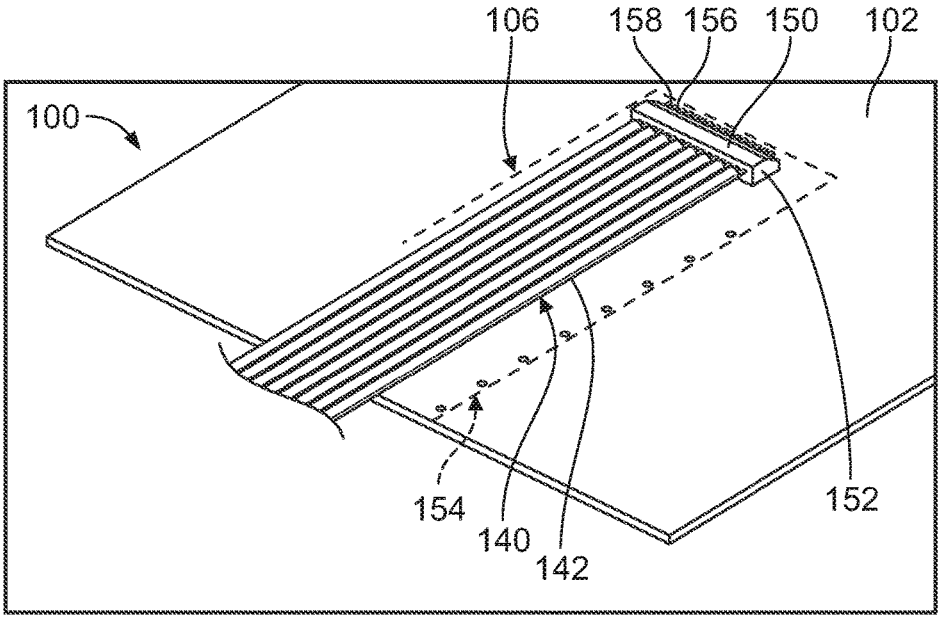
FIG. 3 is a perspective view of a portion of the communication system showing a portion of the pluggable module relative to a host circuit board.

FIG. 3 is a perspective view of a portion of the communication system 100 showing a portion of the pluggable module 106 relative to the host circuit board 102. The cage member 108 (shown in FIG. 1) and the pluggable body 130 (shown in FIG. 2) are removed to illustrate the cable assembly 140 in accordance with an exemplary embodiment. The cable assembly 140 includes the cables 142. The cable assembly 140 includes a cable connector 150 at ends of the cables 142. In an exemplary embodiment, the cable connector 150 includes a shell 152 surrounding portions of the cables 142 and other components of the cable connector 150, such as components configured to be directly mated with the host circuit board 102, as described in further detail below.

The cables 142 and the cable connector 150 are configured to be housed within the pluggable body 130. The cable connector 150 is loaded into and removed from the cage member 108 with the pluggable body 130. Optionally, the pluggable module 106 may include multiple cable connectors 150 within the pluggable body 130 that are each individually mated with the host circuit board 102. For example, multiple cable connectors 150 may be longitudinally spaced between the mating end 132 and the cable end 134 of the pluggable body 130 along the host circuit board 102 (see, for example, FIG. 7).

The cable connector 150 is configured to be directly mated with the host circuit board 102 at a mounting area 154 of the host circuit board 102. For example, the cable connector 150 may be mated directly to signal pads 156 and ground pad 158 within the mounting area 154. Optionally, the host circuit board 102 may include an interposer or other intermediary structure having the signal pads 156 and the ground pads 158 to electrically connect the pluggable module 106 to the host circuit board 102. The receptacle assembly 104 is configured to be mounted to the host circuit board 102 at the mounting area 154. For example, the cage member 108 may be terminated to the host circuit board 102 at the mounting area 154, such as to ground vias in the host circuit board 102.

Figure 4:
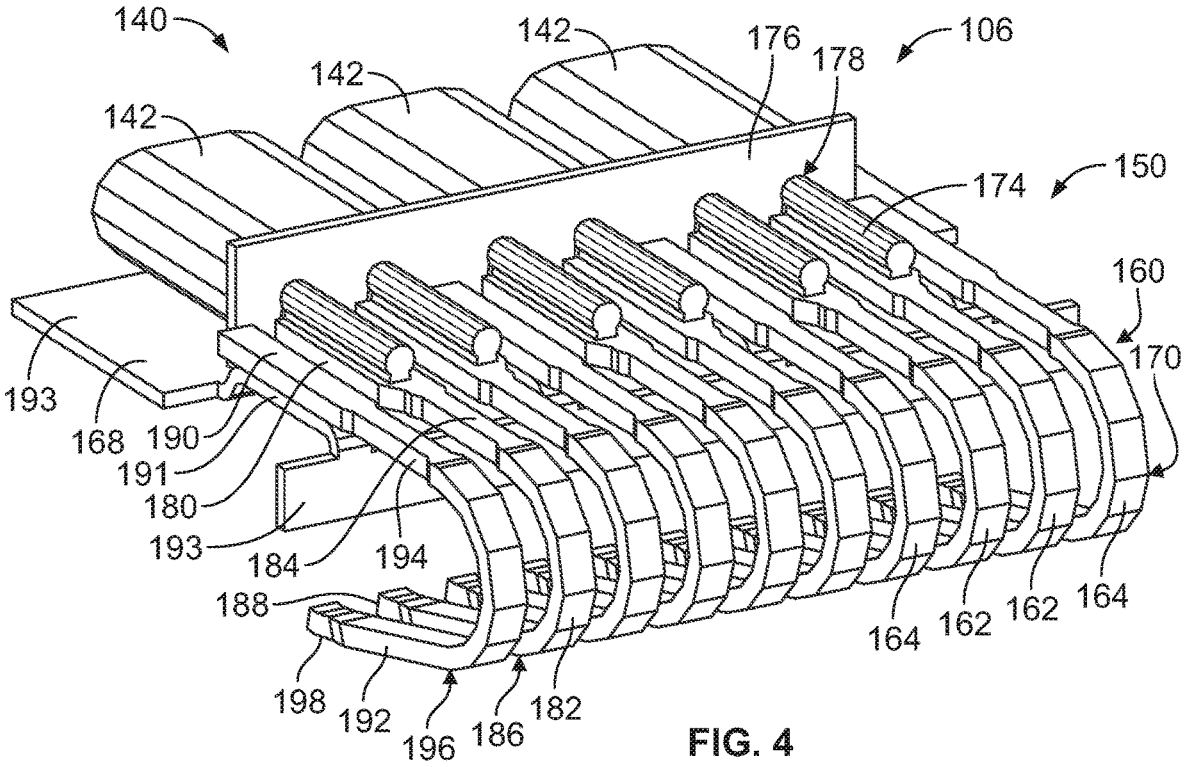
FIG. 4 is a front perspective view of a portion of the pluggable module showing a cable assembly in accordance with an exemplary embodiment.
Figure 5:
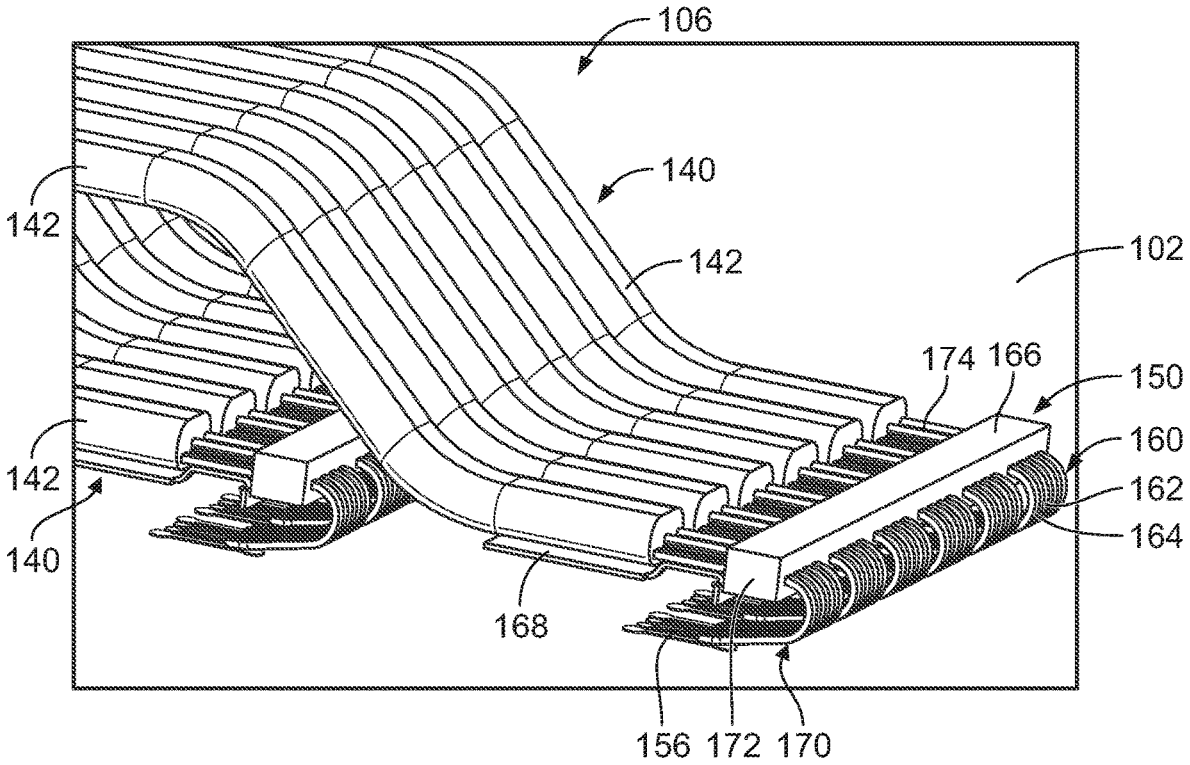
FIG. 5 is a front perspective view of a portion of the pluggable module showing first and second cable assemblies in accordance with an exemplary embodiment.

FIG. 4 is a front perspective view of a portion of the pluggable module 106 showing the cable assembly 140 in accordance with an exemplary embodiment. FIG. 5 is a front perspective view of a portion of the pluggable module 106 showing the first and second cable assemblies 140 in accordance with an exemplary embodiment. The shell 152 (shown in FIG. 3) of the cable connector 150 is removed to illustrate other components of the cable assembly 140.

The cable connector 150 includes a contact assembly 160 configured to be terminated to the cables 142 of the cable assembly 140. The contact assembly 160 is configured to be directly mated with the host circuit board 102 (FIG. 5). The contact assembly 160 includes a plurality of signal contacts 162 and a plurality of ground contacts 164. The contact assembly 160 includes a contact holder 166 (FIG. 5) that holds the signal contacts 162 and the ground contacts 164. The cable connector 150 includes a ground bus 168 that is used to electrically common the ground contacts 164.

In an exemplary embodiment, the contact assembly 160 is an overmolded leadframe. The signal contacts 162 and the ground contacts 164 are a stamped and formed leadframe 170 that is overmolded by an overmolded body 172 that forms the contact holder 166. For example, the signal contacts 162 and the ground contacts 164 may be stamped from a common sheet of metal and held together by a carrier strip prior to being overmolded by the overmolded body 172. Once overmolded, the carrier strip may be removed to singulate the signal contacts 162 and the ground contacts 164. Each of the ground contacts 164 may be electrically connected together by the ground bus 168. In alternative embodiments, rather than singulating the ground contacts 164 from the carrier strip, the carrier strip may be singulated from the signal contacts 162 with the carrier strip forming the ground bus 168 between the ground contacts 164.

In an exemplary embodiment, the signal contacts 162 are arranged in pairs configured to convey differential signals. One or more of the ground contacts 164 are arranged between pairs of the signal contacts 162 to provide electrical shielding between the pairs of signal contacts 162. Other arrangements of signal and ground contacts 162, 164 are possible in alternative embodiments. In some alternative embodiments, rather than providing individual ground contacts 164, the cable connector 150 may include ground shields, such as C-shaped ground shields surrounding the pairs of signal contacts 162.

Each of the signal contacts 162 includes a terminating end 180, a mating end 182 opposite the terminating end 180 and an intermediate portion 184 between the terminating end 180 and the mating end 182. In an exemplary embodiment, the intermediate portion 184 is held by the contact holder 166. For example, the intermediate portion 184 may be overmolded. Optionally, the intermediate portion 184 may be necked down or narrower than other portions, such as to allow more dielectric material between the signal contacts 162 and the ground contacts 164 and/or for signal integrity through the contact holder 166.

The terminating end 180 is terminated to a corresponding signal conductor 174 of the cable 142. For example, the end of the cable 142 may be stripped exposing a length of the signal conductor 174. The signal conductor 174 may be soldered to the terminating end 180. The signal conductor 174 may be terminated to the terminating end 180 by other means in alternative embodiments, such as by crimping, an insulation displacement connection, or another type of termination. In an exemplary embodiment, the contact assembly 160 includes an organizer 176 used for spacing apart the signal conductors 174. The organizer 176 may include slots 178 that receive corresponding signal conductors 174. The slots 178 hold the signal conductors 174 at a predetermined pitch matching the pitch of the signal contacts 162 for termination thereto.

The mating end 182 is configured to be directly mated to the host circuit board 102. In an exemplary embodiment, the signal contact 162 includes a deflectable spring beam 186 at the mating end 182. The deflectable spring beam 186 is configured to be spring biased against the host circuit board 102. The signal contact 162 includes a mating interface 188 at the distal end of the deflectable spring beam 186. The mating interface 188 is configured to be directly mated to the host circuit board 102. Optionally, the signal contact 162 may be curved at the mating interface 188 to allow for contact wipe during mating and to prevent damage to the signal pads 156 on the host circuit board 102. In the illustrated embodiment, the signal contact 162 is folded under to form the deflectable spring beam 186. For example, the mating end 182 extends rearward from the intermediate portion 184 and is then folded under such that the distal end of the deflectable spring beam 186 extends forwardly. The deflectable spring beam 186 is deflectable in a vertical direction when mating to the host circuit board 102. For example, downward pressure on the cable connector 150 presses the signal contacts 162 downward into mating engagement with the host circuit board 102 and compresses the deflectable spring beams 186 such that the deflectable spring beams 186 are spring biased against the host circuit board 102.

Each of the ground contacts 164 includes a terminating end 190, a mating end 192 opposite the terminating end 190 and an intermediate portion 194 between the terminating end 190 and the mating end 192. In an exemplary embodiment, the intermediate portion 194 is held by the contact holder 166. For example, the intermediate portion 194 may be overmolded. Optionally, the intermediate portion 194 may be necked down or narrower than other portions, such as to allow more dielectric material between the ground contacts 164 and the signal contacts 162 and/or for signal integrity through the contact holder 166.

The terminating end 190 is terminated to the ground bus 168. For example, the ground bus includes a terminating portion 191 that engages the terminating end 190. The terminating portion 191 may be soldered to the terminating end 190. The terminating portions 191 are electrically commoned by connecting plates 193. In an exemplary embodiment, one or more of the connecting plates 193 are electrically connected to shield elements of the cables 142. For example, the cables 142 may include a drain wires and/or cable braids and/or a cable foil. The connecting plates 193 may be electrically connected to the drain wires and/or the cable braids and/or the cable foil to ground the cables 142 to the ground bus 168.

The mating end 192 is configured to be directly mated to the host circuit board 102. In an exemplary embodiment, the ground contact 164 includes a deflectable spring beam 196 at the mating end 192. The deflectable spring beam 196 is configured to be spring biased against the host circuit board 102. The ground contact 164 includes a mating interface 198 at the distal end of the deflectable spring beam 196. The mating interface 198 is configured to be directly mated to the host circuit board 102. Optionally, the ground contact 164 may be curved at the mating interface 198 to allow for contact wipe during mating and to prevent damage to the host circuit board 102. In the illustrated embodiment, the ground contact 164 is folded under to form the deflectable spring beam 196. The deflectable spring beam 196 is deflectable in a vertical direction when mating to the host circuit board 102.

Figure 7:
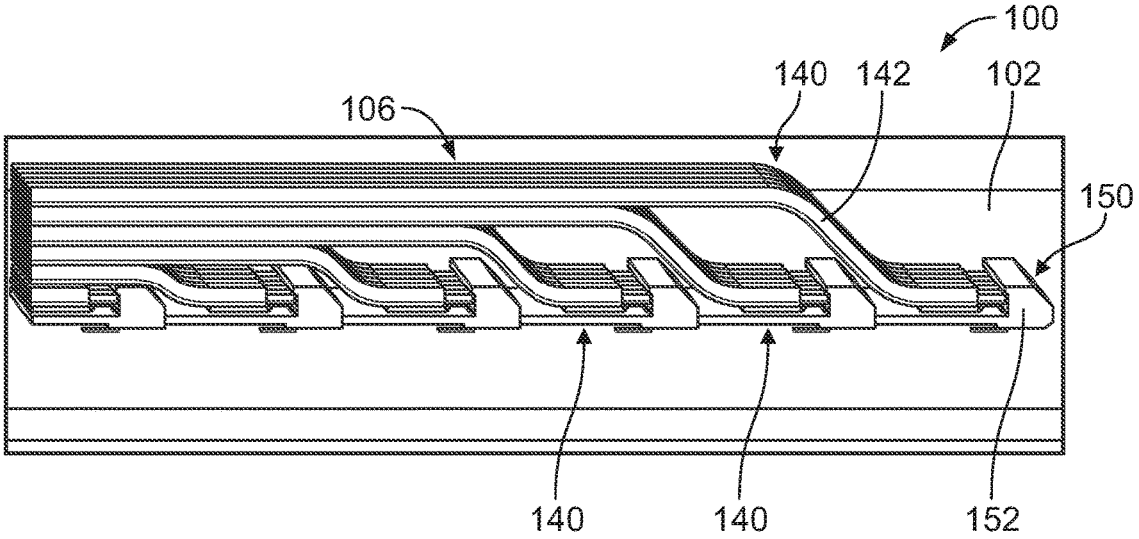
FIG. 7 is a top perspective view of a portion of the communication system showing a portion of the pluggable module relative to the host circuit board.
Figure 6:
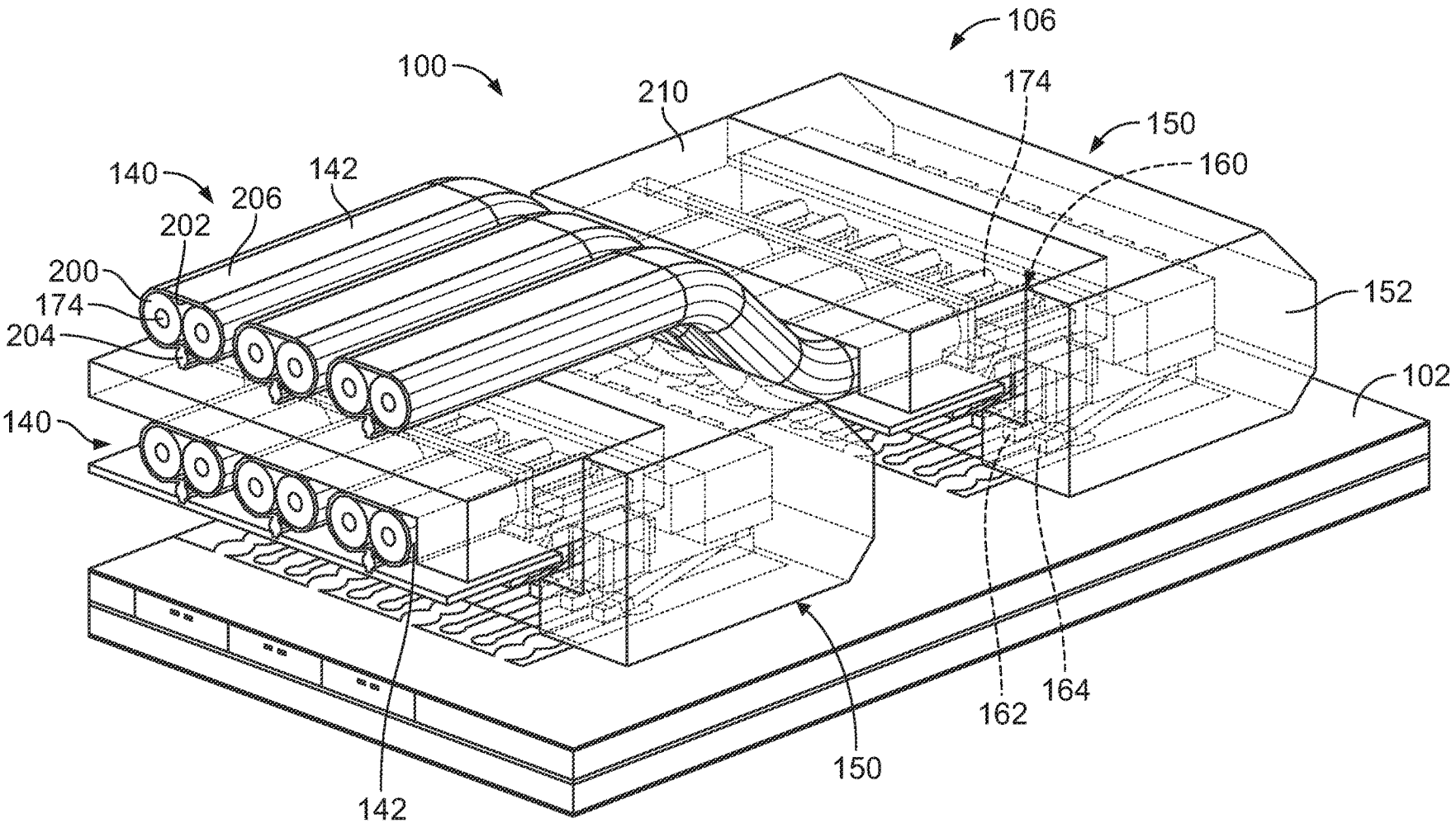
FIG. 6 is a rear perspective view of a portion of the communication system showing a portion of the pluggable module relative to the host circuit board.
Figure 8:
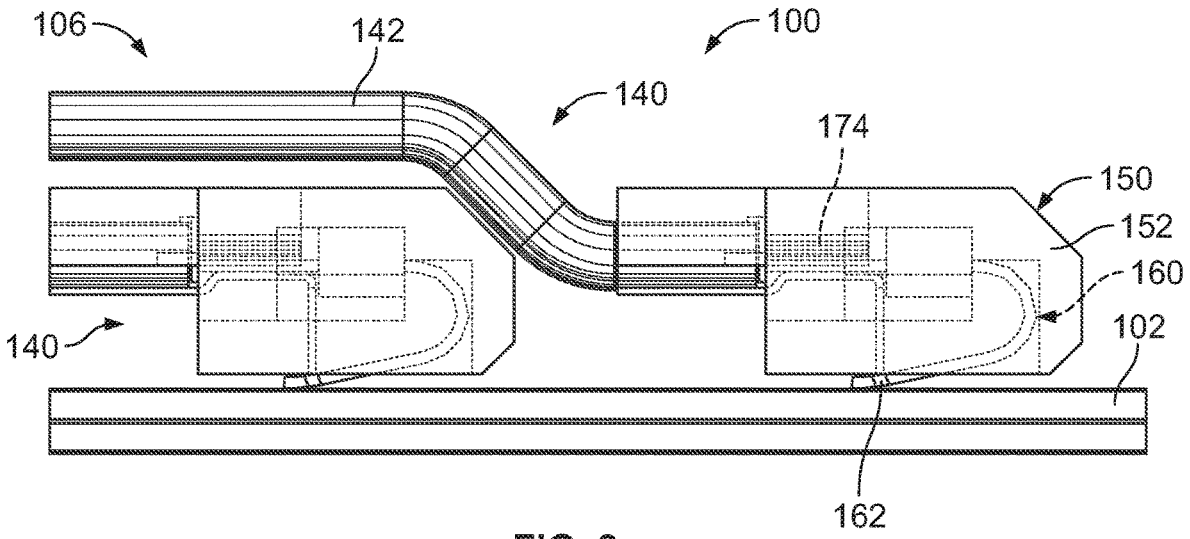
FIG. 8 is a right side view of a portion of the communication system showing a portion of the pluggable module relative to the host circuit board.
Figure 9:
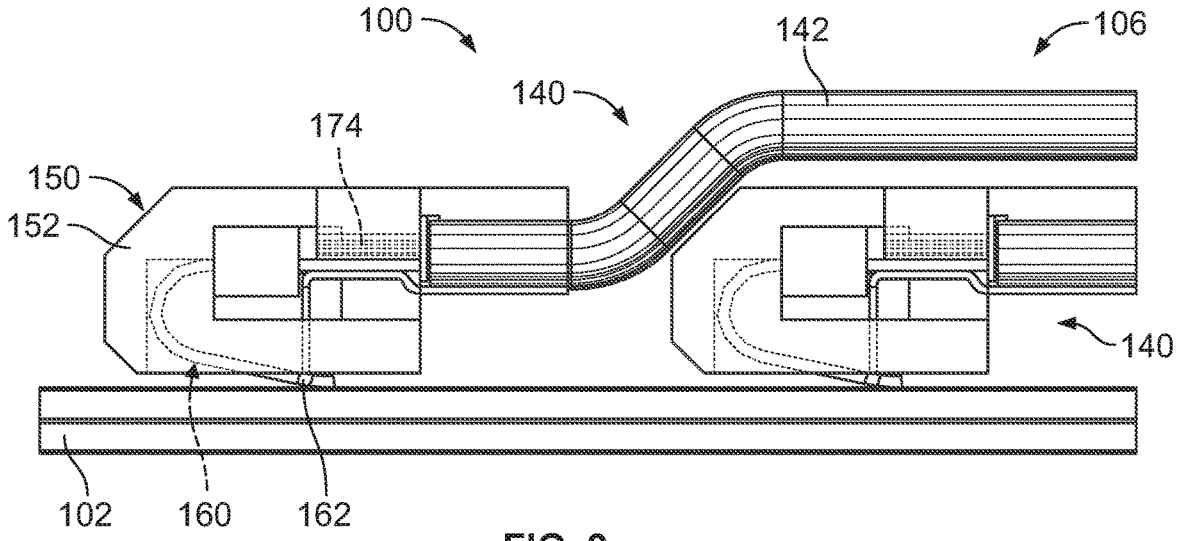
FIG. 9 is a left side view of a portion of the communication system showing a portion of the pluggable module relative to the host circuit board.

FIG. 6 is a rear perspective view of a portion of the communication system 100 showing a portion of the pluggable module 106 relative to the host circuit board 102. FIG. 7 is a top perspective view of a portion of the communication system 100 showing a portion of the pluggable module 106 relative to the host circuit board 102. FIG. 8 is a right side view of a portion of the communication system 100 showing a portion of the pluggable module 106 relative to the host circuit board 102. FIG. 9 is a left side view of a portion of the communication system 100 showing a portion of the pluggable module 106 relative to the host circuit board 102. FIGS. 6-9 show the pluggable module 106 having a plurality of cable assemblies 140.

In an exemplary embodiment, as shown in FIG. 6, each cable 142 may be a twin-axial cable having a pair of the signal conductors 174 with an insulator(s) 200 surrounding the signal conductors 174 and a cable shield 202 providing electrical shielding for the pair of signal conductors 174. Optionally, each cable 142 may include a drain wire 204, as shown in the illustrated embodiment. Each cable 142 includes a cable jacket 206 that protects the cable 142. Other types of cables 142 may be used in alternative embodiments. The cables 142 exit the cable connectors 150.

The shell 152 holds the contact assembly 160 and is positioned over the top of the host circuit board 102 for mating the signal contacts 162 and the ground contacts 164 directly to the host circuit board 102. In an exemplary embodiment, as shown in FIGS. 8 and 9, the shell 152 may be elevated above the host circuit board 102 to allow the signal contacts 162 and the ground contacts 164 to be compressed during mating with the host circuit board 102. For example, the shell 152 may be driven downward in the mating direction toward the host circuit board 102 to compress the signal contacts 162 and the ground contacts 164 against the top surface of the host circuit board 102. Optionally, the receptacle assembly 104 (shown in FIG. 1) includes an actuator that engages the pluggable body 130 (shown in FIG. 2) and/or the shell 152 to press the shell 152 downward toward the host circuit board 102 as the pluggable module 106 is loaded into the receptacle assembly 104. For example, the pluggable module 106 may be loaded forwardly into the receptacle assembly 104 until the pluggable body 130 engages the actuator in the cage member 108, at which time forward loading of the pluggable module 106 is at least partially converted into downward mating of the cable assemblies 140 with the host circuit board 102.

Optionally, the cable assembly 140 may include a strain relief element 210 (FIG. 6) to provide strain relief for the cables 142. The strain relief element 210 may be coupled to the shell 152 to hold the contact assembly 160 and/or the cables 142 relative to the shell 152. The strain relief element 210 may be formed in place over the cables 142 and/or the contact assembly 160. The strain relief element 210 may be formed in place in the shell 152. For example, the strain relief element 210 may be overmolded or a hot melt application.

Figure 10:
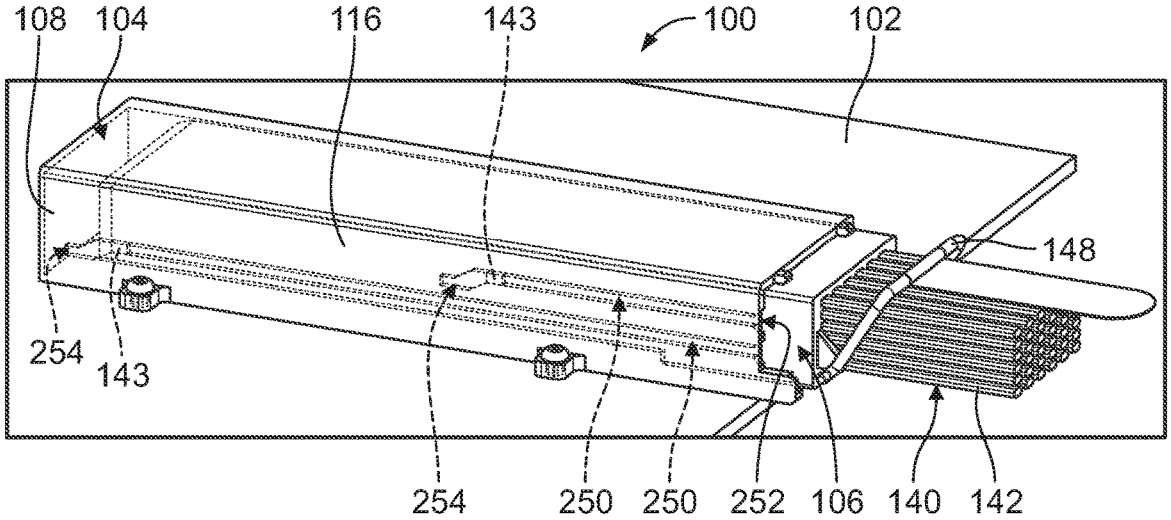
FIG. 10 is a front perspective view of the communication system in accordance with an embodiment showing the pluggable module in a partially loaded position.
Figure 11:
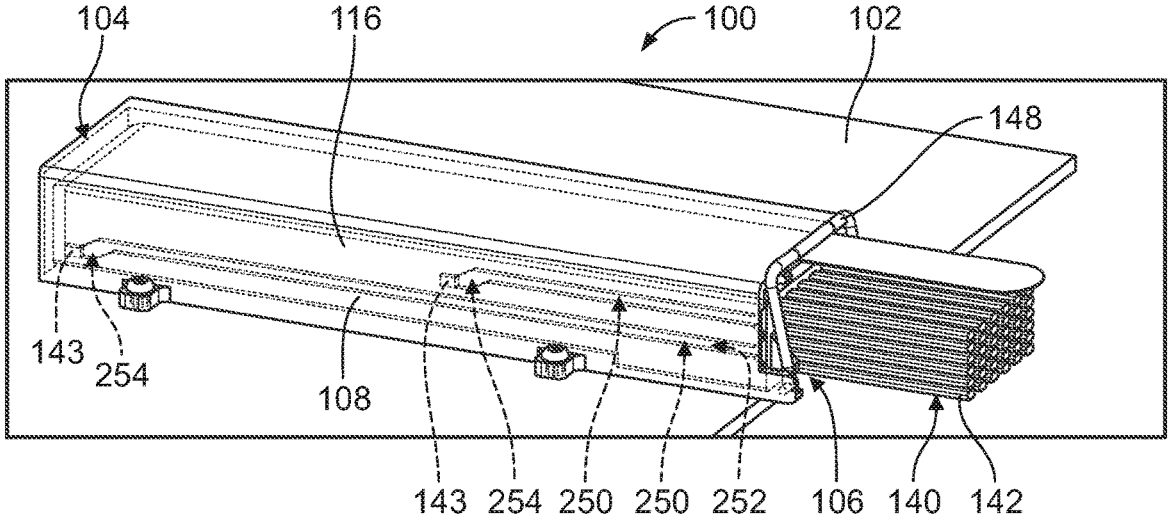
FIG. 11 is a front perspective view of the communication system in accordance with an exemplary embodiment showing the pluggable module in a fully loaded position.

FIG. 10 is a front perspective view of the communication system 100 in accordance with an embodiment showing the pluggable module 106 in a partially loaded position. FIG. 11 is a front perspective view of the communication system 100 in accordance with an exemplary embodiment showing the pluggable module 106 in a fully loaded position. The cage member 108 of the receptacle assembly 104 includes guide features 250 along the walls 116. In the illustrated embodiment, the guide features 250 are guide tracks 252 configured to receive guide features 143 of the pluggable module 106.

In an exemplary embodiment, the guide tracks 252 include seating portions 254 that are used to seat the pluggable module 106 to the host circuit board 102. For example, at the distal ends of the guide tracks 252, the guide tracks 252 are stepped downward to define the seating portions 254. As the pluggable module 106 is loaded into the receptacle assembly 104, the guide features 143 ride in the guide tracks 252 to the seating portions 254. At the seating portions 254, the pluggable module 106 is forced downward toward the host circuit board 102 as the pluggable module 106 is continued to be loaded into the receptacle assembly 104. In the illustrated embodiment, the seating portions 254 are ramped at an angle such that the pluggable module 106 has both horizontal and vertical movement in the seating portion 254. As the pluggable module 106 is forced downward toward the host circuit board 102, the pluggable module 106 is electrically connected to the host circuit board 102. The signal contacts 162 and the ground contacts 164 are mated to the contact pads of the host circuit board 102. The deflectable spring beams 186, 196 of the signal and ground contacts 162, 164 are compressed when mated with the host circuit board 102.

In an exemplary embodiment, the actuator 148 of the latch 144 may be used to force the pluggable module 106 in the loading direction. For example, the operator may press on the actuator 148 to push the pluggable module 106 in the loading direction. During removal, the operator may pull in the actuator 148 to remove the pluggable module 106 from the receptacle assembly 104. During removal, the guide tracks 252 may guide removal of the pluggable module 106. The guide features 143 ride in the guide tracks 252 during removal. Other types of latching features and guide features may be used in alternative embodiments.

Figure 12:
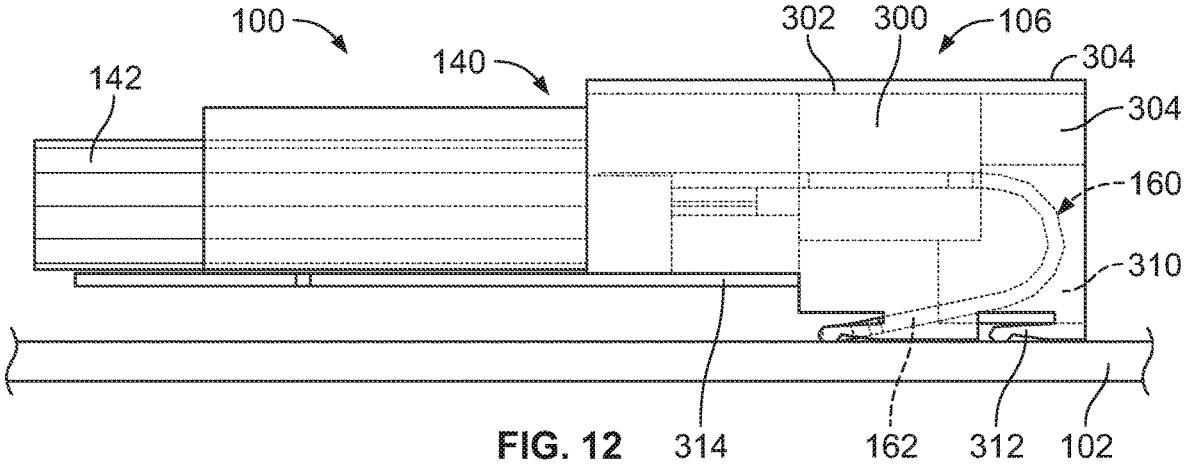
FIG. 12 is a side view of a portion of the communication system in accordance with an exemplary embodiment showing a portion of the pluggable module relative to the host circuit board.
Figure 13:
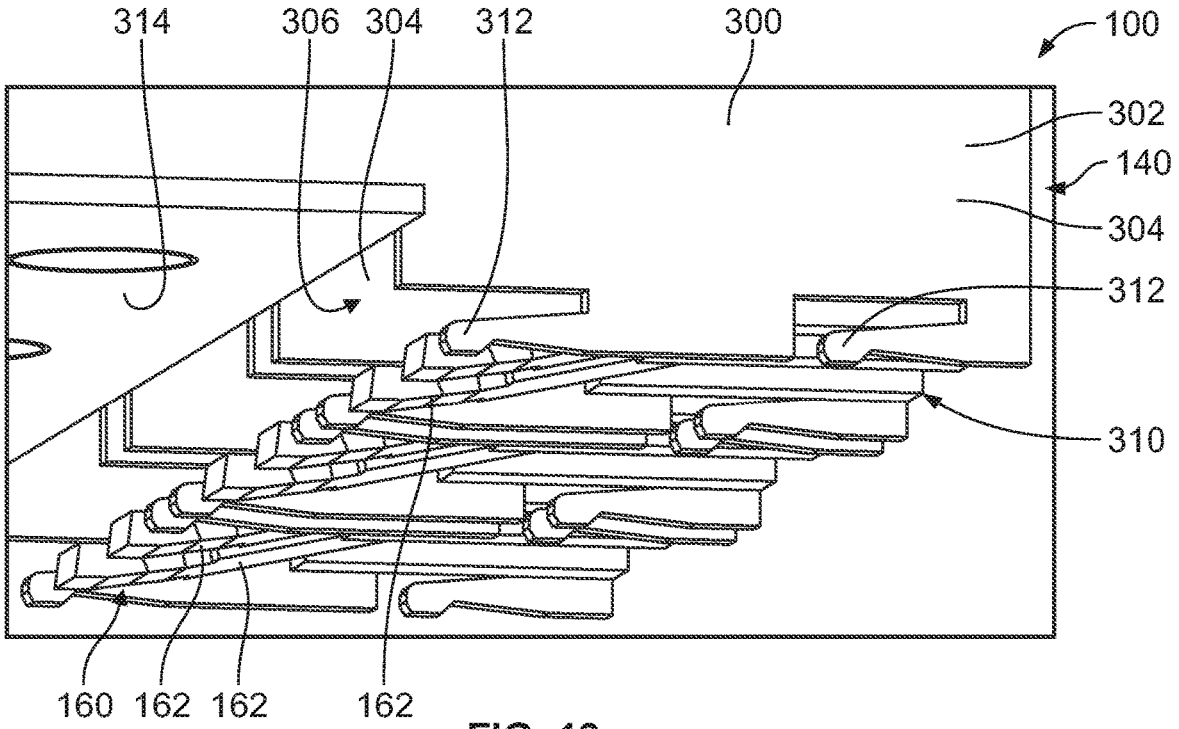
FIG. 13 is a bottom perspective view of a portion of the pluggable module in accordance with an exemplary embodiment.
Figure 14:
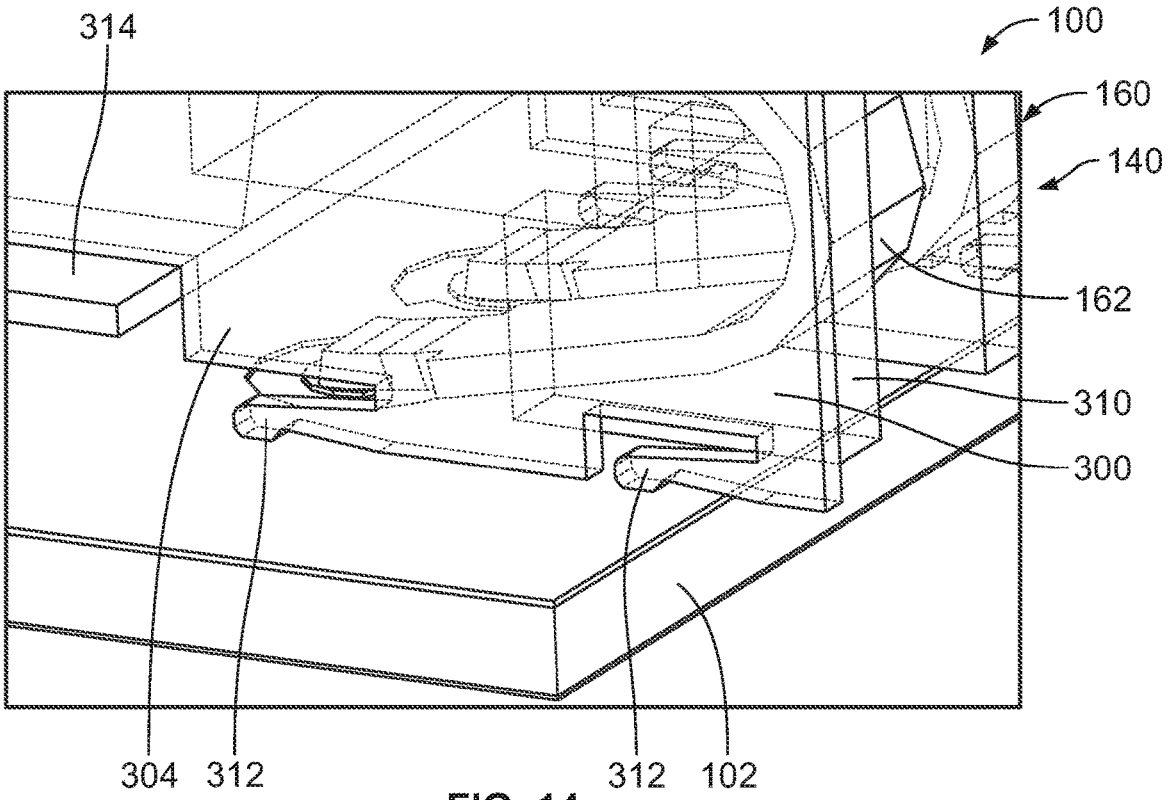
FIG. 14 is a top perspective view of a portion of the communication system showing a portion of the pluggable module relative to the host circuit board.

FIG. 12 is a side view of a portion of the communication system 100 in accordance with an exemplary embodiment showing a portion of the pluggable module 106 relative to the host circuit board 102. FIG. 13 is a bottom perspective view of a portion of the pluggable module 106 in accordance with an exemplary embodiment. FIG. 14 is a top perspective view of a portion of the communication system 100 showing a portion of the pluggable module 106 relative to the host circuit board 102. The embodiment illustrated in FIGS. 10-12 utilizes ground shields 300 rather than the ground contacts 164 (shown in FIG. 4).

The ground shield 300 includes a shield body 302 having a plurality of walls 304 that form a shield pocket 306. The cable 142 extends into the shield pocket 306 of the ground shield 300. The contact assembly 160 is arranged in the shield pocket 306 of the ground shield 300. For example, the pairs of the signal contacts 162 are held by corresponding contact holders 310. The shield body 302 at least partially surrounds the signal contacts 162 to provide electrical shielding. For example, in the illustrated embodiment, the walls 304 of the shield body 302 extend along 3 sides of the pairs of signal contacts 162 to form a C-shaped shield pocket 306.

Each ground shield 300 includes a plurality of ground contacts 312 along the bottom of the shield body 302. The ground contacts 312 are configured to be directly mated to the host circuit board 102. The ground contacts 312 are deflectable and are configured to engage a ground plane and/or ground pads on the host circuit board 102. Optionally, the ground contacts 312 may be aligned with the signal contacts 162 to provide electrical shielding between the pairs of signal contacts 162.

In an exemplary embodiment, the cable assembly 140 includes a ground bus 314 electrically connecting each of the ground shields 300 together. In the illustrated embodiment, the ground bus 314 is a plate extending along the bottom of each of the ground shields 300. The ground bus 314 may be electrically connected to each of the cables 142, such as to the drain wire and/or the cable braid and/or the cable foil of the cable 142. The ground shields 300 may be soldered, welded or otherwise bonded to the ground bus 314. Alternatively, the ground shields 300 may include compliant pins, such as eye of the needle pins, which are electrically connected to the ground bus 314.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a host circuit board having a mounting area and signal pads within the mounting area;

a receptacle assembly mounted to the host circuit board at the mounting area, the receptacle assembly having a cage member including a plurality of walls defining a module cavity, the walls providing electrical shielding around the module cavity, the cage member having a port at a front of the cage member open to the module cavity; and a pluggable module having a pluggable body including a mating end and a cable end, the mating end of the pluggable body loaded into the module cavity of the receptacle assembly through the port, the pluggable body having a mating interface along a bottom of the pluggable body facing the host circuit board, the pluggable module having a cable assembly held by the pluggable body, the cable assembly having a cable exiting the pluggable body at the cable end, the cable assembly having a cable connector at an end of the cable, the cable connector including signal contacts held by a contact holder, the signal contacts being terminated to signal conductors of the cable, the signal contacts having deflectable spring beams and mating interfaces along the deflectable spring beams exposed at the mating interface of the pluggable body to engage and directly mate with corresponding signal pads of the host circuit board, wherein each signal contact has a terminating end, a mating end and an intermediate portion between the terminating end and the mating end, the signal conductors being terminated to the signal contacts at the corresponding terminating end, the contact holder engaging and holding the intermediate portion, the deflectable spring beam extending from the contact holder to the mating end to engage the host circuit board.

2. The communication system of claim 1, wherein the intermediate portion is located forward of the terminating end, the deflectable spring beam being folded under such that the mating end extends rearwardly.

3. The communication system of claim 1, wherein the contact holder includes an overmolded body molded around the signal contacts to hold the signal contacts at a predetermined pitch for termination to the signal conductors and for mating with the signal pads of the host circuit board.

4. The communication system of claim 1, wherein the signal contacts are arranged in pairs carrying differential signals.

5. The communication system of claim 1, wherein the cable assembly further comprises ground contacts held by the contact holder providing electrical shielding for the signal contacts, the ground contacts having mating interfaces exposed to the mating interface of the pluggable body to engage and directly mate with the host circuit board.

6. The communication system of claim 5, wherein the cable assembly further comprises a ground bus bar configured to engage and electrically connect a plurality of the ground contacts together.

7. The communication system of claim 5, wherein the ground contacts have deflectable spring beams extending from the contact holder to engage the host circuit board.

8. The communication system of claim 1, wherein the cable assembly includes a plurality of cables including the cable, the plurality of cables being terminated to corresponding signal contacts.

9. The communication system of claim 1, wherein the cable connector includes a shell holding the contact holder, the receptacle assembly engaging the shell to press the cable connector downward toward the host circuit board to compress the deflectable spring beams against the host circuit board.

10. The communication system of claim 1, wherein the cage member includes a guide track having a seating portion, the pluggable module having a guide feature being received in the guide track to guide mating and unmating of the pluggable module with the cage member, wherein the deflectable spring beams of the signal contacts are compressed against and electrically connected to the host circuit board when the guide feature is in the seating portion of the guide track.

11. The communication system of claim 1, wherein the cable assembly is a first cable assembly, the pluggable module further comprising a second cable assembly held by the pluggable body, the second cable assembly having a second cable exiting the pluggable body at the cable end, the second cable assembly having a second cable connector at an end of the second cable, the second cable connector including a second signal contacts held by a second contact holder, the second signal contacts being terminated to the second signal conductors of the second cable, the second signal contacts having deflectable spring beams and mating interfaces along the deflectable spring beams exposed at the mating interface of the pluggable body to engage and directly mate with the second signal pads on the host circuit board, the second cable assembly being longitudinally offset from the first cable assembly such that the second cable connector is positioned closer to the cable end of the pluggable body than the cable connector of the first cable assembly.

12. The communication system of claim 1, wherein the cable assembly includes a leadframe defining the signal contacts, the leadframe being overmolded by a dielectric overmolded body defining the contact holder.

13. The communication system of claim 1, wherein the pluggable module further comprises C-shields forming shield pockets receiving corresponding signal contacts, the C-shields having ground contacts exposed at the mating interface of the pluggable body to engage and directly mate with the host circuit board.

14. A pluggable module comprising:

a pluggable body having a mating end and a cable end, the pluggable body having a mating interface along a bottom of the pluggable body, the mating end of the pluggable body configured to be loaded into a receptacle assembly such that the mating interface faces a host circuit board; and a cable assembly held by the pluggable body, the cable assembly having a cable exiting the pluggable body at the cable end, the cable assembly having a cable connector at an end of the cable, the cable connector including signal contacts held by a contact holder, the signal contacts being terminated to signal conductors of the cable, the signal contacts having deflectable spring beams and mating interfaces along the deflectable spring beams exposed at the mating interface of the pluggable body to engage and directly mate with signal pads on the host circuit board, wherein each signal contact has a terminating end, a mating end and an intermediate portion between the terminating end and the mating end, the signal conductors being terminated to the signal contacts at the corresponding terminating end, the contact holder engaging and holding the intermediate portion, the deflectable spring beam extending from the contact holder to the mating end to engage the host circuit board.

15. The pluggable module of claim 14, wherein the contact holder includes an overmolded body molded around the signal contacts to hold the signal contacts at a predetermined pitch for termination to the signal conductors and for mating with the signal pads of the host circuit board.

16. The pluggable module of claim 14, wherein the cable assembly further comprises ground contacts held by the contact holder providing electrical shielding for the signal contacts, the ground contacts having mating interfaces exposed to the mating interface of the pluggable body to engage and directly mate with the host circuit board, the ground contacts having deflectable spring beams extending from the contact holder to engage the host circuit board.

17. The pluggable module of claim 14, wherein the cable assembly is a first cable assembly, the pluggable module further comprising a second cable assembly held by the pluggable body, the second cable assembly having a second cable exiting the pluggable body at the cable end, the second cable assembly having a second cable connector at an end of the second cable, the second cable connector including a second signal contacts held by a second contact holder, the second signal contacts being terminated to the second signal conductors of the second cable, the second signal contacts having deflectable spring beams and mating interfaces along the deflectable spring beams exposed at the mating interface of the pluggable body to engage and directly mate with the second signal pads on the host circuit board, the second cable assembly being longitudinally offset from the first cable assembly such that the second cable connector is positioned closer to the cable end of the pluggable body than the cable connector of the first cable assembly.

18. The pluggable module of claim 14, wherein the cable connector includes a shell holding the contact holder, the receptacle assembly engaging the shell to press the cable connector downward toward the host circuit board to compress the deflectable spring beams against the host circuit board.

19. The pluggable module of claim 14, further comprising a guide feature configured to engage a mating guide feature fixed relative to the host circuit board to guide mating and unmating of the pluggable module with the host circuit board, wherein the deflectable spring beams of the signal contacts are compressed against and electrically connected to the host circuit board when the guide feature is mated with the mating guide feature.

20. A pluggable module comprising:

a pluggable body having a mating end and a cable end, the pluggable body having a mating interface along a bottom of the pluggable body extending longitudinally between the mating end and the cable end, the mating end of the pluggable body configured to be loaded into a receptacle assembly in a mating direction parallel to a host circuit board, the pluggable body configured to be received in the receptacle assembly such that the mating interface faces the host circuit board;

a first cable assembly held by the pluggable body, the first cable assembly having a first cable exiting the pluggable body at the cable end, the first cable assembly having a first cable connector at an end of the first cable, the first cable connector including first signal contacts held by a first contact holder, the first signal contacts being terminated to first signal conductors of the first cable, the first signal contacts having deflectable spring beams and mating interfaces along the deflectable spring beams exposed at the mating interface of the pluggable body to engage and directly mate with first signal pads on the host circuit board; and a second cable assembly held by the pluggable body, the second cable assembly having a second cable exiting the pluggable body at the cable end, the second cable assembly having a second cable connector at an end of the second cable, the second cable connector including second signal contacts held by a second contact holder, the second signal contacts being terminated to second signal conductors of the second cable, the second signal contacts having deflectable spring beams and mating interfaces along the deflectable spring beams exposed at the mating interface of the pluggable body to engage and directly mate with second signal pads on the host circuit board;

wherein the second cable assembly is longitudinally offset from the first cable assembly such that the second cable connector is positioned closer to the cable end of the pluggable body than the first cable connector.

* * * * *